US008375841B2

(12) United States Patent
Bocini et al.

(10) Patent No.: US 8,375,841 B2
(45) Date of Patent: Feb. 19, 2013

(54) ARMOR TILE

(75) Inventors: Loriano Bocini, Vinci (IT); Francesco Borghini, Vinci (IT); Riccardo Rovai, Vinci (IT); Shmuel Genihovich, Nazareth Ellite (IL); Eliyahu Herush, Misgav (IL); Mark Pak, Karmiel (IL)

(73) Assignees: Industrie Bitossi, S.p.A., Sovigliana, Vinci (Firenze) (IT); Plasan Sasa Ltd., M.P. Marom Hagalil (IL)

( * ) Notice: Subject to any disclaimer, the term of this patent is extended or adjusted under 35 U.S.C. 154(b) by 0 days.

(21) Appl. No.: 13/161,280

(22) Filed: Jun. 15, 2011

(65) Prior Publication Data

US 2012/0067200 A1 Mar. 22, 2012

Related U.S. Application Data

(63) Continuation-in-part of application No. 12/587,059, filed on Sep. 30, 2009, now abandoned.

(30) Foreign Application Priority Data

Jun. 17, 2009 (IT) ..... FI2009A0130
Dec. 16, 2010 (IL) ..... 210048

(51) Int. Cl.
*F41H 5/02* (2006.01)

(52) U.S. Cl. ..... 89/36.02; 89/903

(58) Field of Classification Search ..... None
See application file for complete search history.

(56) References Cited

U.S. PATENT DOCUMENTS

| | | | | |
|---|---|---|---|---|
| 3,736,838 | A * | 6/1973 | Butterweck et al. | 89/36.02 |
| 4,347,796 | A | 9/1982 | King et al. | |
| 4,704,943 | A | 11/1987 | McDougal | |
| 4,981,067 | A | 1/1991 | Kingery | |
| 5,007,326 | A | 4/1991 | Gooch, Jr. et al. | |
| 5,221,807 | A | 6/1993 | Vives | |
| 5,824,940 | A | 10/1998 | Chediak et al. | |
| 5,972,819 | A | 10/1999 | Cohen | |
| 6,112,635 | A | 9/2000 | Cohen | |
| 6,203,908 | B1 | 3/2001 | Cohen | |
| 6,240,858 | B1 | 6/2001 | Mandall | |
| 6,289,781 | B1 | 9/2001 | Cohen | |
| 6,405,630 | B1 * | 6/2002 | Gonzalez | 89/36.02 |
| 6,892,623 | B2 | 5/2005 | Benyami et al. | |
| 7,712,407 | B2 | 5/2010 | Ravid et al. | |
| 2002/0088340 | A1 | 7/2002 | Chu et al. | |
| 2004/0216595 | A1 | 11/2004 | Dickson | |
| 2005/0217471 | A1 | 10/2005 | Benitsch | |

(Continued)

FOREIGN PATENT DOCUMENTS

| | | |
|---|---|---|
| DE | 9421063 | 7/1995 |
| DE | 102008035388 | 2/2010 |

(Continued)

OTHER PUBLICATIONS

International Search Report from International Application No. PCT/EP2010/058520 mailed Aug. 24, 2010.

(Continued)

*Primary Examiner* — Michael Carone
*Assistant Examiner* — Reginald Tillman, Jr.
(74) *Attorney, Agent, or Firm* — Workman Nydegger

(57) ABSTRACT

In an embodiment, a monolithic tile made for use in a composite armor is disclosed. The tile includes cut-out and/or through thickness channels spaced from each other at a distance greater than a dimension of the channels, in a plan view of the tile.

21 Claims, 4 Drawing Sheets

U.S. PATENT DOCUMENTS

| | | | |
|---|---|---|---|
| 2006/0162537 | A1 | 7/2006 | Anderson, Jr. et al. |
| 2007/0125223 | A1 | 6/2007 | Heidenrech et al. |
| 2007/0252234 | A1 | 11/2007 | Kawamata et al. |
| 2008/0264244 | A1 | 10/2008 | Ravid et al. |
| 2009/0136702 | A1 | 5/2009 | Gu |
| 2009/0229453 | A1 | 9/2009 | Dickson |
| 2010/0089228 | A1 | 4/2010 | Scott et al. |
| 2010/0319523 | A1 | 12/2010 | Bocini et al. |

FOREIGN PATENT DOCUMENTS

| | | |
|---|---|---|
| EP | 1705452 | 9/2006 |
| EP | 1731870 | 12/2006 |
| EP | 1878993 | 1/2008 |
| EP | 2023072 | 2/2009 |
| FR | 2731512 | 9/1996 |
| GB | 2377006 | 12/2002 |
| WO | WO2005114089 | 12/2005 |

OTHER PUBLICATIONS

U.S. Appl. No. 12/587,059, Mar. 16, 2011, Office Action.
U.S. Appl. No. 29/394,280, filed Jun. 15, 2011, Genihovich et al.
International Search Report, PCT/IL2011/050061 mailed Apr. 25, 2012, 3 pages.

* cited by examiner

ARMOR TILE

CROSS-REFERENCE TO RELATED APPLICATIONS

This application is a continuation-in-part of U.S. application Ser. No. 12/587,059 filed 30 Sep. 2009, now abandoned, which claims priority to Italian Patent Application No. FI2009A000130 filed 17 Jun. 2009. This application also claims priority to Israeli Patent Application No. 210048 filed 16 Dec. 2010. The contents of each of the foregoing application are hereby incorporated by reference in their entirety.

TECHNICAL FIELD

This invention relates to the ceramic armor component field.

BACKGROUND

Ceramic armor is typically used for body armor and for the protection of different types of vehicles, such as various types of land vehicles, ships, and aircraft.

Usually, ceramic armor is made of a ceramic tile and composite material as backing. Typically, ceramic tiles are adhesively secured to a substrate then encapsulated in an outer cover. The substrate and cover represent the backing composite material.

The ceramic armor system is then attached to a vehicle by a variety of means or merely placed in a fabric pocket, as in the case of body armor.

The function of the ceramic layer is to break the bullets, while the function of the composite backing is to hold the ceramic in places during the impact and to catch the fragments produced during the impact and dissipate their mechanical energy by a plastic deformation.

A very important characteristic of ceramic component armors is their ability to defeat multiple shots within a relatively small area. The challenge in developing multi-hit ceramic composite armor is to control the damage of the armor structure after the impact in its proximity. While metal armor have inherently this characteristic, that is related to the metal ductility and ability to withstand plastic deformation, in ceramic armor components it must be addressed by an appropriate design of the armor components.

The damage produced in ceramic hard face components by projectile impact can be classified into (1) a comminution zone of highly pulverized material in the shape of a conoid under the incident projectile footprint, (2) radial and circumferential cracks, (3) spalling, through the thickness and lateral directions by reflected tensile pulses, and (4) impact from comminuted fragments.

Crack propagation is arrested at the boundaries of an impacted tile if the web between the tiles in the tile array is properly designed. However, stress wave propagation can occur through the web and into the adjacent tiles and can still damage the adjacent tiles.

As far as the ceramic layer is considered, the most common approach to increase the multi-hit capability of a ceramic composite armor is the use of ceramic tile mosaics. The physical separation between the tiles in the mosaic constitutes a barrier to the propagation of the ceramic damage that occurs during the impact. In this way the area of the ceramic strike face damaged by an impact is limited to the size of the tile or maximum to a portion of two if the impact occurs across the junction.

From the industrial point of view, the drawback of this approach is the increased complexity introduced in the composite manufacturing. During the bonding of the tiles, great care must be used to avoid that an excessive gap between the tiles is introduced. While a minimum gap (0.1-0.3 mm) may be beneficial, an excessive one (0.5 mm or greater) constitute a week point of the ceramic armor to be avoided.

For the above mentioned reasons, the lay-up of mosaic in the construction of composite armor on industrial scale is the most labor intensive production phase. Usually, tiles are aligned manually by trained personnel. The increasing multi-hit requirements are forcing armor designer to adopt more and more mosaics based on small ceramic, like tiles 20 mm×20 mm or 30 mm×30 mm. When using such small tiles, the number of components per square meter increases very rapidly to more than 1000-2000 units.

An additional drawback of ceramic components armor based on mosaics is how to guarantee that in the finished armor every gap between the tiles in below the maximum allowed (usually 0.3/4 mm). The only possibility is to X-ray the entire panel to measure the gap between the tiles. This is a significant expensive measurement.

In order to overcome the above said difficulties, it has been thought to use larger tiles with some discontinuities in their structure. These slots can involve the whole tiles thickness or only part of it and function as breaking barrier to the crack propagation during the impact phase.

In the patent requests EP 1 878 933, WO 2005114089 and GB 2377006 are described different applications of the above said solution.

Unfortunately, this finding did not reveal itself as completely satisfying since it implicates serious manufacturing problems. In fact, ceramic tiles are not easily cut because of their typical hardness.

This is the reason why in literature reference is always made to ceramic carbides the mechanical manufacturing necessity or to the complex forming processes and always regarding ceramic carbides.

Since the market constantly requires strong, low-cost and easily realized armors with high multi-hit properties, it is evident the need to develop ceramic monolithic tiles that do not involve a complex mosaic structure, capable of overcoming the manufacturing problems relevant to the realization to the slots described before.

SUMMARY

There is provided in accordance with the presently disclosed subject matter a monolithic tile made, for example, of a ceramic material, for use in a composite armor, having cut-out and/or through thickness channels spaced from each other at a distance greater than the dimension of the channels, in a plan view of the tile.

DETAILED DESCRIPTION

It has been surprisingly noted that ceramic tiles with penetrating cylindrical channels distributed in various ways, are extremely suitable for manufacturing ceramic armors, avoiding the before mentioned production drawbacks, and offer unexpected advantages in comparison with the analogous tiles with slots, as described here below.

Figure 1A:
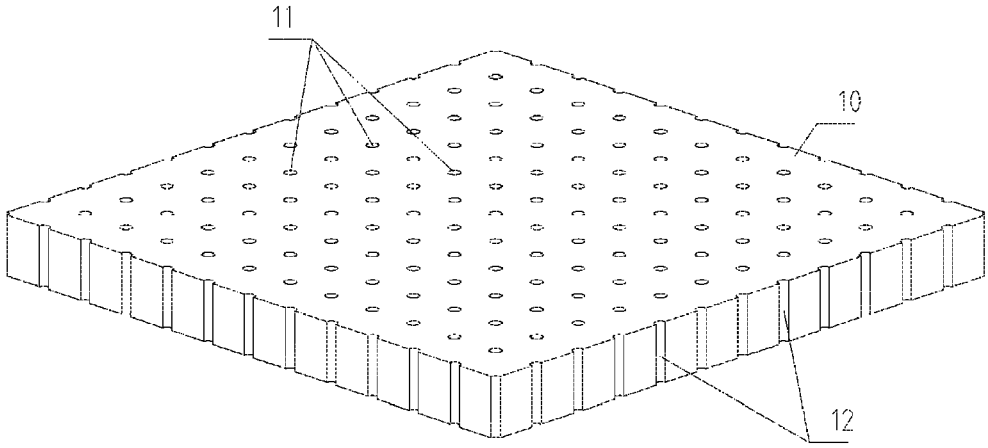
FIGS. 1*a* and 1*b* show a schematic representation of an embodiment of a ceramic tile and a perpendicular section, respectively.
Figure 1B:
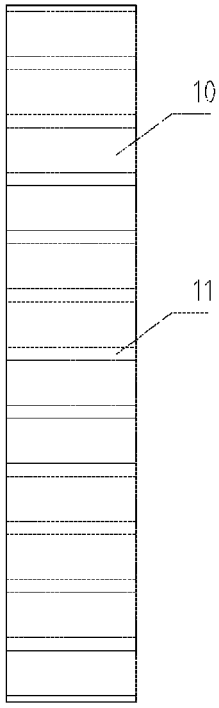

As appears from FIG. 1, ceramic tiles for armors according to an embodiment of the invention are standard tiles (10) with channels (11) joining the opposite front and rear surfaces of the tile. These surfaces can be planar as shown, or at least the front surface can have domed projections (not shown), disposed between the channels.

Tiles can have smooth and continuous borders or they can present (12) cavities represented by part of the channels (11) (preferably an half of total number as shown in FIG. 1).

Channels can be simple holes or hollow tubes placed in the body of the tile, constituting an open channel on both opposite surfaces.

Channels can have circular or polygonal section (e.g., square, hexagonal, triangular, or pentagonal) and can be substantially perpendicularly disposed or inclined across the tiles surfaces.

Figures 2A, 2B, 2C:
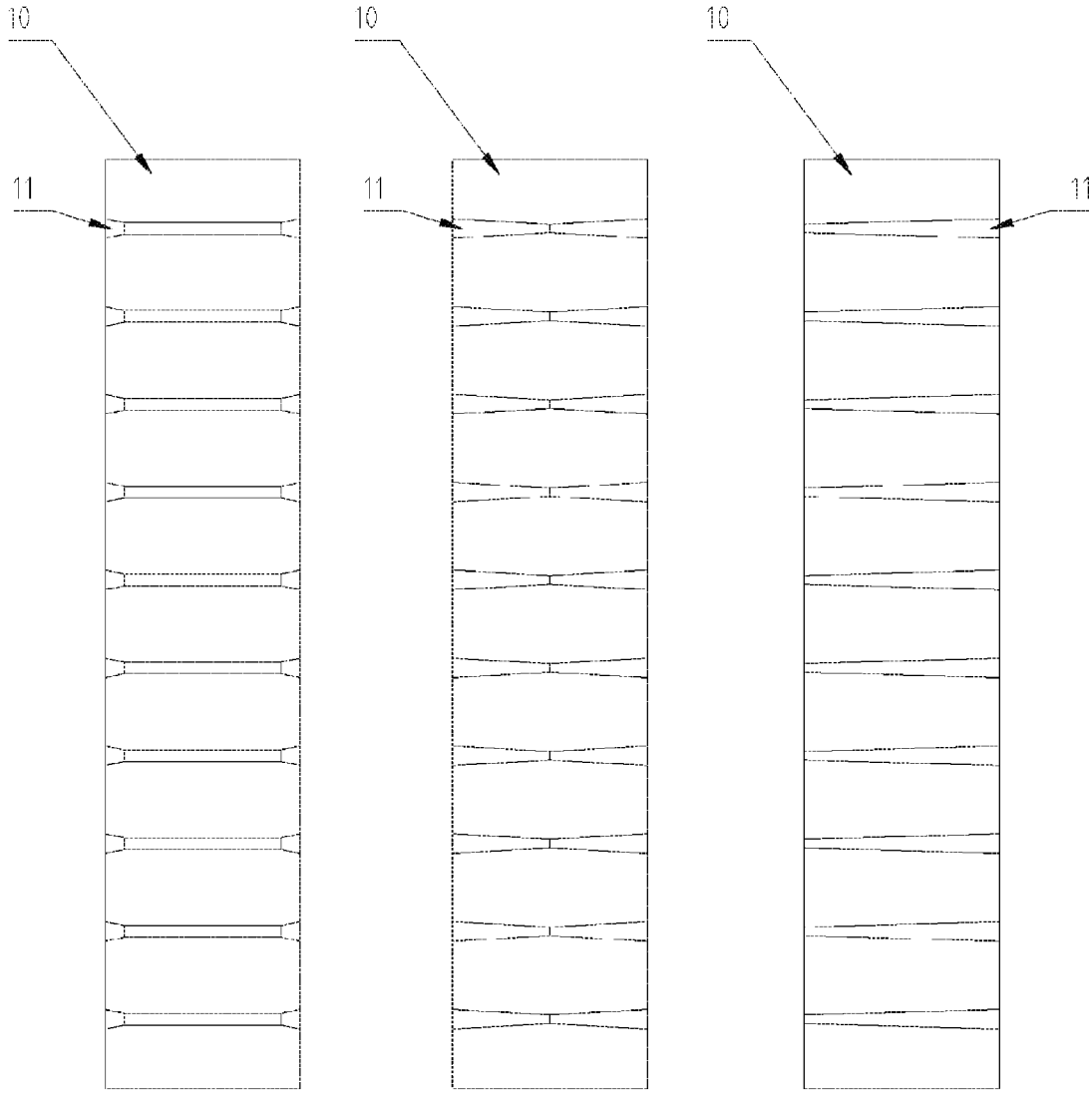
FIG. 2*a*-2*c* show details of channels realization in section.
Figure 3A:
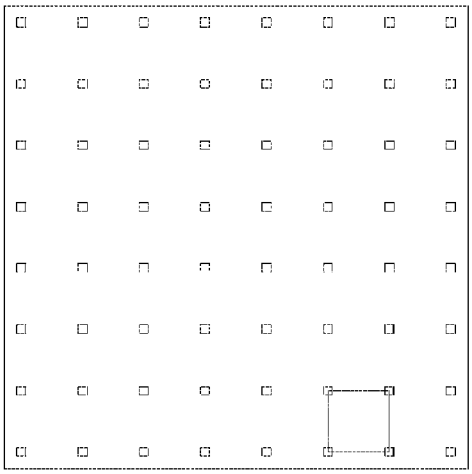
FIG. 3*a*-3*e* show different embodiments of the invention in which channels are disposed according to various geometries.
Figure 3B:
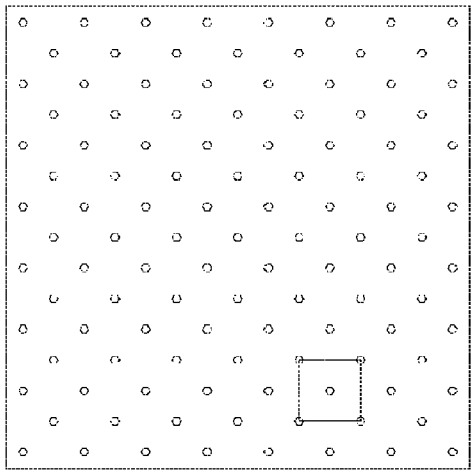
Figure 3C:
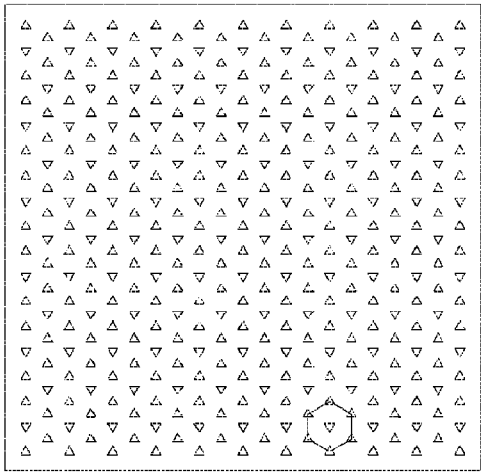
Figure 3D:
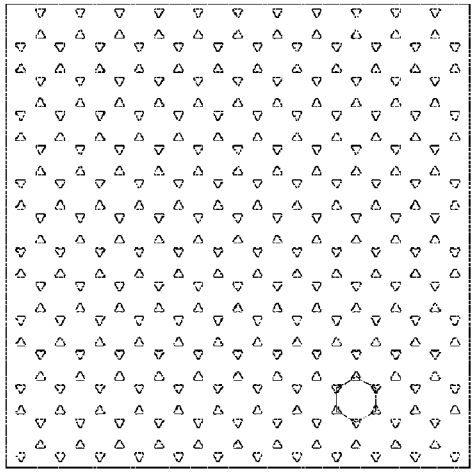
Figure 3E:
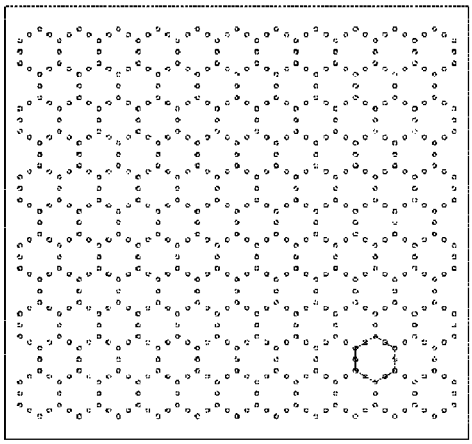

Preferably, channels internal dimensions should be between 0.5 and 5 mm. In addition, if necessary, channels could have a rectangular (FIG. 1*a*), conic or biconic inner section, or be tapered off at one or the other or both ends (FIG. 2*a-c*).

The presence of channels considerably increases the multi-hit resistance because shock wave propagation through the tile is stopped thanks to these diffraction lines inside the material itself.

One of the most common causes of the collapse of ceramic components is the propagation of shock waves created by the impact of projectile against the armor. It is known in literature that the attenuation of the shock waves inside the ceramic parts considerably improves the ceramic armor ballistic performance. Such mitigation is usually obtained by introducing longitudinal discontinuities (see U.S. Pat. No. 4,704,943 and US Patent Application Publication No. 20090136702). While in embodiments of the invention, discontinuities involve the whole thickness of tiles uniformly distributed on the surface. This characteristic sensibly increases the above mitigation power.

In addition, the internal volume of the channels may be streamlined with materials that have an acoustic impendence, as for example, alumina, zirconia, boron carbide, silicon carbide, silicon nitride, silica, or mixtures thereof, metals such as copper, iron, steel and wolfram, different from the ceramic one such as plastic materials (low acoustic impendence), metallic/ceramic materials (high acoustic impendence), or combinations of any of the foregoing materials. In so doing, it is possible to modulate the mitigation power of the shock waves according to the different threats to be arrested. In fact, because of their different impact velocity, they create wave trains different for frequency and intensity.

A further advantage of one or more embodiments of the invention is the weight reduction obtained by the presence of channels. This characteristic is very important because ballistic armors always represent a parasitic weight.

Embodiments of the invention involve tiles commonly made of ceramic materials, such as aluminum oxide, boron carbide, silicon carbide, glass ceramic materials, titanium diboride, mixtures thereof, combinations thereof, or other similar products. The tiles may be manufactured following well-known processes (e.g., using molds or by extrusion).

In the same way, the channels related to this invention are easily realized, by casting, extrusion or by cold pressing using moulds with punch matrixes. These are the most common forming techniques used for mass production.

Possible streamline can be easily conducted during the manufacturing process of the ballistic panel or as an intermediate phase after the ceramic tile production, while filling of channels can be made successively, after the monolithic tile production and can obtained by fusion of plastic, metal or vitreous materials.

In case of ceramic materials, channels can be filled with powder that is sintered with an additional thermal treatment.

A further producing system consists of the co-shaping of two ceramic powders or a ceramic and metal one. Recently, systems of co-injection of different ceramic materials have been set up, in order to obtain composite ceramic products.

Again, another manufacturing system consists of the filling of a mold with two powders, that are the matrix and the channels, with the second one placed upright resembling channels shape. Multiple components proportioning systems are well known and used in many technical ceramics applications.

It is important to note that tiles with channels are sensibly more homogeneous compared to the tiles with slots described in the state of the art. In fact, channels create 2-10 mm discontinuities (channels diameter 1 mm, at a distance of 2 mm from each other) while slots create discontinuities of 20-50 mm. A higher discontinuity density heightens the effects and improves the capacity of arresting of the fracture propagation.

The presence of channels permits the mechanical connection of the two parts of the ballistic inserts making the whole structure more strong and firm. While there is no possibility to reach this purpose with tiles with slots because such slots should not have a diameter of more than 0.5 mm.

The high discontinuity density enhances the multi-hit power, in fact near to the impact point there will always be conjunction points between the two parts of the composite panel (front and rear). This increases the ceramic confinement. It is well known in literature that the ceramic confinement improves the multi-hit characteristics.

The ceramic fragments produced in the impact will be better hold together and confined thanks to the high density of the connections.

Channels can be distributed in the ceramic body of the tiles in a casual way or according to repeated geometric drawings, such as: parallel lines equidistant or at different distances from each other. The size of the channels and their distribution can be such that maximal dimension of each channel is less than spacing between the closest points of each two adjacent channels.

Channels can be disposed in squares, hexagons, star-like shape etc. as schematically shown in FIG. 3. This is better illustrated in FIG. 4, where it is shown that imaginary lines connecting centers of the channels can form polygons whose size is defined by a diameter D of an imaginary circled inscribed therein. Each channel can thus be defined by a circle of a diameter d, in which it is inscribed, the diameter d not exceeding 0.6 D, e.g. not exceeding 0.5 D or 0.3 D.

Figure 4A:
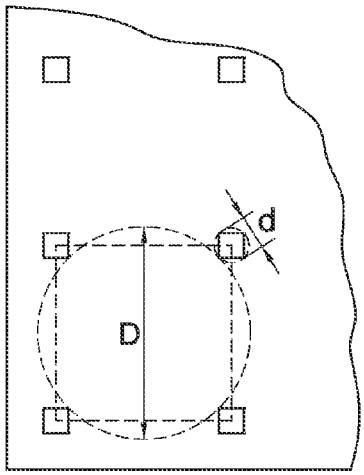
FIG. 4*a*-4*e* show in more detail designs which tiles shown in FIG. 3 can have according to various embodiments.
Figure 4B:
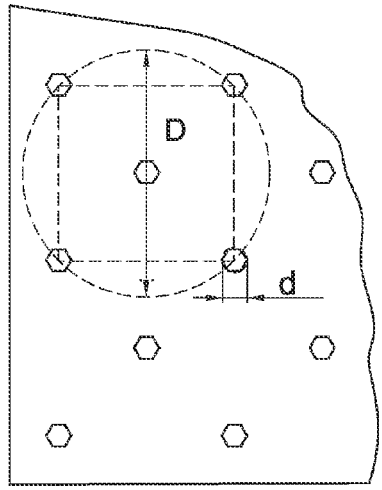
Figure 4C:
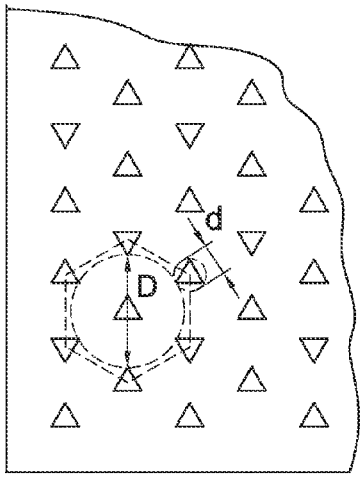
Figure 4D:
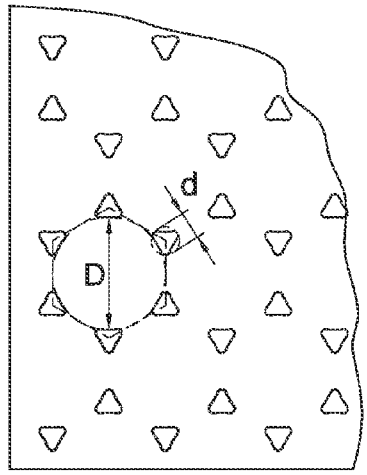
Figure 4E:
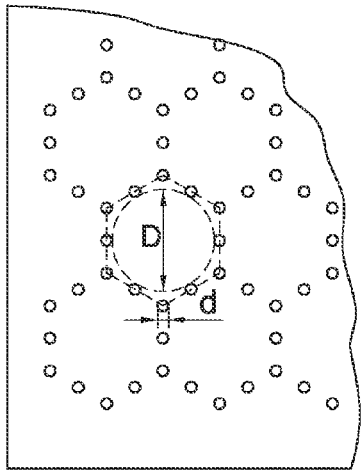

As shown in FIG. 4*d*, when the channels are triangular, their sides can have slightly concave form so that the sides of six channels, facing each other lie on the imaginary circle of the diameter D. As seen, the concave sides can merge via convex arcs constituting apexes of the triangular channels. The convex arcs can have a radius r1 which is smaller than the radius r2=d/2 of the circle in which each triangular channel is inscribed. In particular, the ratio r1:r2 can be between 1:2 and 1:5.

The invention claimed is:

1. A tile for use in an armor, the tile comprising:

a tile body at least partially made from a ceramic material, the tile body including a plurality of channels extending through a thickness thereof and distributed so that a maximal dimension of each of the plurality of channels, in a plan view of the tile, is smaller than a distance between adjacent channels of the plurality of channels;

wherein the tile body includes edges and edge areas extending inwardly from the edges, the edge areas being free of the plurality of channels, the plurality of channels distributed along an entire area defined between the edge areas; and wherein the plurality of channels are arranged so that imaginary lines connecting respective centers of the adjacent channels form a plurality of hexagons, each of a majority of the plurality of hexagons having all sides thereof common with adjacent hexagons of the plurality of hexagons.

2. The tile according to claim 1, wherein at least some of the plurality of channels, in the plan view of the tile, have a polygonal shape.

3. The tile according to claim 2, wherein the polygonal shape is a triangular shape.

4. The tile according to claim 1, wherein at least some of the plurality of channels have a polygonal section.

5. The tile according to claim 4, wherein the polygonal section is triangular.

6. The tile according to claim 1, wherein each of the plurality of channels have rectangular, conic, or biconic section taken along a height thereof.

7. The tile according to claim 1, wherein the ceramic material includes at least one material selected from the group consisting of aluminium oxide, boron carbide, silicon carbide, glass-ceramics, and titanium diboride.

8. A tile for use in an armor, the tile comprising:

a tile body at least partially made from a ceramic material, the tile body including a plurality of channels extending through a thickness thereof and distributed so that a maximal dimension of each of the plurality of channels, in a plan view of the tile, is smaller than a distance between closest points of each pair of adjacent channels of the plurality of channels;

wherein the tile body includes edges and edge areas extending inwardly from the edges, the edge areas being free of the plurality of channels, the plurality of channels distributed along an entire area defined between the edge areas; and wherein the plurality of channels are arranged so that imaginary lines connecting respective centers of the adjacent channels form a plurality of hexagons, each of a majority of the plurality of hexagons having all sides thereof common with adjacent hexagons of the plurality of hexagons.

9. The tile according to claim 8, wherein in the plan view, each of the plurality of hexagons is defined by a large inscribed circle having a diameter D and each of the plurality of channels is defined by a small circle of a diameter d that is smaller than D.

10. The tile according to claim 8, wherein at least some of the plurality of channels have a polygonal shape, in the plane view of the tile, defining a polygonal channel.

11. The tile according to claim 10, wherein at least some of the plurality of channels have a triangular shape, in the plan view of the tile, defining a triangular channel.

12. The tile according to claim 8, wherein in a cross-section of the plurality of channels taken substantially perpendicular to thickness of the tile, the shape of the channels is the same as that in the plan view of the tile.

13. The tile according to claim 10, each of the polygonal channels comprises corners that are rounded.

14. The tile according to claim 11, wherein in the plan view of the tile, each of the triangular channels have sides of a concave shape.

15. The tile according to claim 14, wherein the concave sides merge via convex arcs constituting apexes of the triangular channels.

16. The tile according to claim 14, wherein the concave sides of six channels, which sides face each other, lie on a large imaginary circle having a diameter D.

17. The tile according to claim 16, wherein each of the plurality of channels is defined by a small circle of a diameter d, in which it is inscribed, the diameter d being smaller than D.

18. The tile according to claim 8, wherein each of the plurality of channels has a height axis that is substantially perpendicular to a front surface and a rear surface of the tile body or is inclined in with respect to the front and rear surfaces.

19. The tile according to claim 8, wherein the tile body is a unitary body.

20. A tile for use in an armor, the tile comprising:

a tile body at least partially made from a ceramic material, the tile body including a plurality of channels extending through a thickness thereof and distributed so that a maximal dimension of each of the plurality of channels, in a plan view of the tile, is smaller than a distance between adjacent channels of the plurality of channels;

wherein the plurality of channels are arranged so that imaginary lines connecting respective centers of the adjacent channels form a plurality of hexagons, each of the plurality of hexagons defined by an imaginary circle; and wherein each of the plurality of channels has a generally triangular shape with three sides, in the plan view of the tile, such that each of the three sides of a majority of the generally triangular shapes extends along a respective one of the imaginary circles.

21. A tile for use in an armor, the tile comprising:

a tile body at least partially made from a ceramic material, the tile body including a plurality of channels extending through a thickness thereof and distributed so that a maximal dimension of each of the plurality of channels, in a plan view of the tile, is smaller than a distance between closest points of each pair of adjacent channels of the plurality of channels;

wherein the plurality of channels are arranged so that imaginary lines connecting respective centers of the adjacent channels form a plurality of hexagons, each of the plurality of hexagons defined by an imaginary circle; and wherein each of the plurality of channels has a generally triangular shape with three sides, in the plan view of the tile, such that each of the three sides of a majority of the generally triangular shapes extends along a respective one of the imaginary circles.

* * * * *

UNITED STATES PATENT AND TRADEMARK OFFICE

CERTIFICATE OF CORRECTION

PATENT NO. : 8,375,841 B2
APPLICATION NO. : 13/161280
DATED : February 19, 2013
INVENTOR(S) : Loriano Bocini et al.

It is certified that error appears in the above-identified patent and that said Letters Patent is hereby corrected as shown below:

Title Page

Item 30, Foreign Application Priority Data, change "Jun. 17, 2009, (IT), FI2009A0130" to --Jun. 17, 2009, (IT), FI2009A000130--

Signed and Sealed this
Twenty-third Day of April, 2013

Teresa Stanek Rea
*Acting Director of the United States Patent and Trademark Office*